US005709107A

United States Patent [19]

Jeffcoat

[11] Patent Number: 5,709,107

[45] Date of Patent: Jan. 20, 1998

[54] KNITTING METHOD

[75] Inventor: Keith Jeffcoat, Nuneator, United Kingdom

[73] Assignee: General Motors Corporation, Detroit, Mich.

[21] Appl. No.: 709,365

[22] Filed: Sep. 9, 1996

Related U.S. Application Data

[62] Division of Ser. No. 546,261, Oct. 20, 1995.

[30] Foreign Application Priority Data

Nov. 10, 1994 [GB] United Kingdom ..... 9422674

[51] Int. Cl.[6] ..... D04B 9/46

[52] U.S. Cl. ..... 66/179; 66/189

[58] Field of Search ..... 66/170, 179, 189

[56] References Cited

U.S. PATENT DOCUMENTS

| | | | |
|---|---|---|---|
| 422,886 | 3/1890 | Kilbourn | 66/189 |
| 2,237,144 | 4/1941 | Houseman | 66/179 |
| 2,800,782 | 7/1957 | Bridges | 66/179 |
| 2,860,500 | 11/1958 | Crawford | 66/179 X |
| 3,079,780 | 3/1963 | Kale et al. | 66/179 |
| 3,252,306 | 5/1966 | Bentley et al. | 66/89 |
| 3,537,279 | 11/1970 | Epley | 66/189 X |
| 3,882,697 | 5/1975 | Betts et al. | 66/189 X |
| 4,100,769 | 7/1978 | Nurk | 66/177 |
| 5,038,585 | 8/1991 | Robinson et al. | 66/170 |
| 5,127,242 | 7/1992 | Mitsumoto | 66/200 |
| 5,163,306 | 11/1992 | Boehm et al. | 66/177 |
| 5,213,863 | 5/1993 | Day et al. | 428/71 |
| 5,215,807 | 6/1993 | Day et al. | 428/193 |
| 5,253,492 | 10/1993 | Mitsumoto | 66/69 |
| 5,308,141 | 5/1994 | Robinson et al. | 297/218 |
| 5,326,150 | 7/1994 | Robinson et al. | 297/218 |

FOREIGN PATENT DOCUMENTS

| | | |
|---|---|---|
| 408074 | 1/1925 | Germany . |
| 1339423 | 12/1973 | United Kingdom . |
| 2206609 | 1/1989 | United Kingdom . |
| 2223034 | 3/1990 | United Kingdom . |
| 2223036 | 3/1990 | United Kingdom . |
| 2253219 | 9/1992 | United Kingdom . |

*Primary Examiner*—John J. Calvert
*Attorney, Agent, or Firm*—George A. Grove

[57] ABSTRACT

A method of determining the shape of a knitting pattern for continuous knitting of a three-dimensional weft knitted object having a two-dimensional development in which at least one pair of edges to be knitted together have a large angle therebetween in excess of x° where x° is the maximum knittable angle between edges for the particular application of the cover. The method produces a cover having distinct sutures including a first suture formed from knitting together two edges with two sutures extending from one end of the first suture to intersect another suture extending from the other end of the first suture at a point.

4 Claims, 4 Drawing Sheets

KNITTING METHOD

This is a division of application Ser. No. 08/546,261 filed on Oct. 20, 1995.

FIELD OF THE INVENTION

This invention relates to a knitted fabric cover and a method of continuously knitting a fabric cover for a three-dimensional object, the whole cover being formed in a single operation requiring no further sewing or processing.

BACKGROUND OF THE INVENTION

The invention is useful in machine knitting on a weft knitting machine having independently operable needles disposed in at least two needle beds, for example, a flat V-bed machine producing a mainly double jersey structure. In such machines, the width of the knitted fabric is restricted by the maximum number of needles available for forming a course across the machine bed.

Knitted three-dimensional fabric structures for covering three-dimensional objects are produced from two-dimensional material and have in the past been produced by weaving or knitting shaped parts and panels and sewing them together.

More recently, it has been found possible to knit one-piece upholstery fabric, which removes the need for sewing portions together, and has the desired shape to serve as covers for the base and back cushions for vehicle seats; see, for example, British Patent 2,223,034. A problem that has arisen with the continuous knitting of three-dimensional fabric structures is that it has hitherto been impossible to knit satisfactory joint edges where the angle between the edges-to-be-joined in the two-dimensional form exceeds 135°, and generally the maximum angle for continuous knitting together of edges should not exceed an angle of 90° depending upon the application. Generally, the larger the angle between the edges-to-be-joined, the poorer the appearance and strength of the joint. British Patent Application GB-A-2,223,036 discusses in detail the problems associated with continuous knitting of edges-to-be-joined having large angles therebetween.

SUMMARY OF THE INVENTION

The invention provides for a continuous knitted three-dimensional object and a method of knitting the same which includes joined edges at large angles, that is, edges having a large subtended angle therebetween when in the two-dimensional development stage.

According to the present invention, there is provided a knitted cover for a three-dimensional object and which includes a first knitted suture formed from knitting together two edges with further straight suture lines extending from each end of the first suture to a point of intersection.

The two edges comprising the first suture may be curved or multi-facetted, although preferably the first suture is a straight suture line.

Also according to the present invention there is further provided a knitting pattern for continuous knitting of a three-dimensional weft knitted cover having at least one knitted joint formed from two knitted-together edges, said knitting pattern having two substantially congruent areas for each respective knitted joint with one pair of first sides, preferably identical sides, corresponding with the edges which form the respective knitted joint, intersecting to link the areas together at a first point $P_1$, with two other sides of each area being straight lines intersecting at a second point $P_2$.

The maximum included angle between the pair of first sides should not exceed x°, where x° is the maximum knittable angle for the particular application of the cover and will generally lie between 90° and 135°.

In the knitting pattern, the edges-to-be-joined preferably have the same length and any angle between them is preferably equally bisected by a horizontal line. By horizontal is meant a line in a course-wise direction.

Preferably said one pair of faces are also straight lines, and the congruent areas are triangular areas.

Yet another aspect of the present invention provides a method of determining the shape of a two-dimensional knitting pattern for continuous knitting in a single operation of a three-dimensional weft knitted object having a two-dimensional development in which at least one pair of edges to be knitted together have a large angle therebetween in excess of x°, said method comprising forming a two-dimensional development, determining the wale-wise direction for knitting, and performing a geometric rearrangement on portions of the two-dimensional development adjacent said large angle so that said large angle is transformed into a plurality of smaller angles of less than x° between a plurality of pairs of edges-to-be-joined so that any non-horizontal edges to be joined together in the knitting operation have the same length, and said edges are biased at equal angles to the course-wise direction of the fabric. Preferably, the smaller angles should not exceed 90°.

A further aspect of the present invention provides a method of continuously knitting a three-dimensional cover, said method comprising determining the shape of a knitting pattern as described above, and then continuously knitting the object with said edges being joined together during the knitting operation.

BRIEF DESCRIPTION OF THE DRAWINGS

The invention will be described by way of example and with reference to the accompanying drawings in which.

DESCRIPTION OF THE PREFERRED EMBODIMENT

Figure 1:
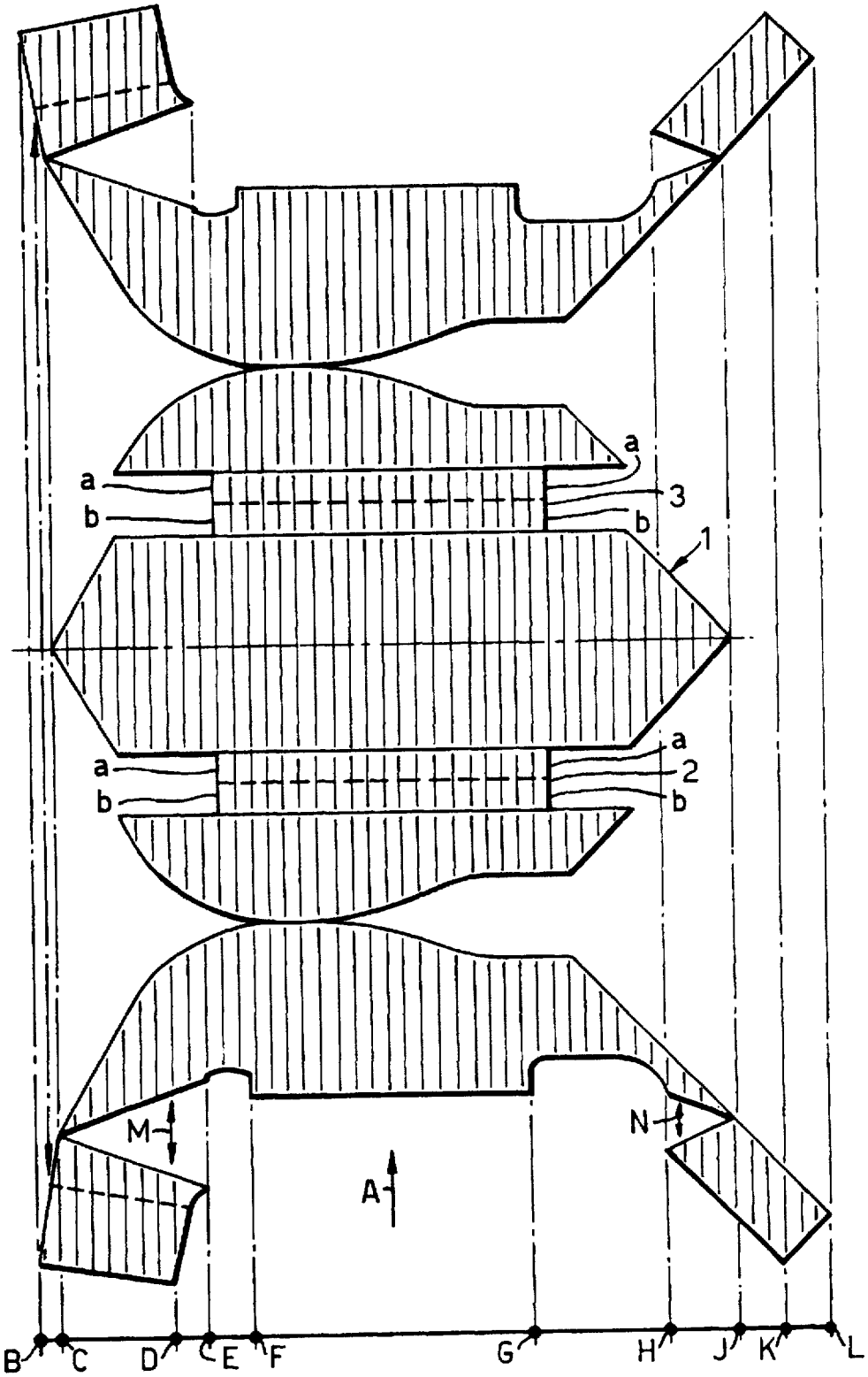
PRIOR ART Fig.1.
FIG. 1 shows a prior art knitting pattern.

FIG. 1 is a prior art diagram taken from EP-A-361,855 showing one way in which a fabric piece 1 for covering a seat base of an automobile seat can be continuously weft knitted in a single operation. The fabric piece 1 is of mainly double jersey structure and is knitted on a flat V-bed knitting machine provided with a conventional presser foot device or other loop hold-down device for holding down the knitted fabric between the opposed needle beds of the machine. The direction of knitting, indicated by arms A, is such that the wales of the fabric piece extend in a desired manner across the seat base. This may be dictated by a pattern on the fabric or by other technical considerations.

The knitting of the fabric piece 1 is described in details in GB-A-2,223,034 and will only be described herein so as to give background information for understanding the present invention.

In FIG. 1, the line B–L represents the length of opposed needle beds of the machine in which the piece 1 is knitted. The needles operate to form fabric along vertical lines only (that is, in wales). Essentially the knitting begins on a few needles at point D on the needle bed, and more needles are brought progressively into action course-by-wale in the direction from D–B and from D–E to begin to define the edges of the material. Similarly, knitting will commence at point K with needles being brought progressively into action from K–H and from K–L. The needles are then made progressively active and/or inactive in order to obtain the required shape of the fabric.

During the continuous knitting operation from bottom to top of the fabric, edges of the fabric as indicated by double ended arrows are knitted together. Taking the two edges indicated by double-headed arrows M and N, for example, this requires that needles made inactive between the point C and E, and H and J, respectively, are progressively reactivated to "join" the two edges indicated by M and N along vertical lines.

Integral open ended loops may be formed by knitting the areas 2 and 3 on one needle bed only, or alternatively the areas 2 and 3 are utilized by folding along the dotted lines for forming the open ended loops beneath the seat cover for facilitating incorporation of the cover into a seat.

Now it will be apparent that during the knitting operation only those points that lie on a vertical line (a needle line) on a joint can be integrally joined.

Therefore, if it is necessary to join edges which meet so that there are large angles between the edges, say in excess of 90° for a particular application, then these edges have hitherto been impossible to join satisfactorily. For example, the edge a and b of the areas 2 and 3 which are folded to form loops would lie at 180° and would be impossible to join together by continuous knitting. The difficulties in continuously knitting together edges which subtend large angles therebetween are discussed in U.S. Pat. No. 5,038,585.

According to one aspect of the invention, FIGS. 2A, 2B, 2C, 2D, 2E and 2F schematically demonstrate how large angle edges can be joined together, for example, when such edges are incorporated into a substantially horizontally orientated pouch incorporated into a knitted fabric. It will be appreciated that the examples shown are non-limiting and that the techniques demonstrated can be utilized in the production of car seat covers or other products in which the initial two-dimensional development has edges-to-be-joined with large angles therein between. The edge-to-be-joined could be at the edges of the fabric as well as at the end of a pouch.

Figure 2A:
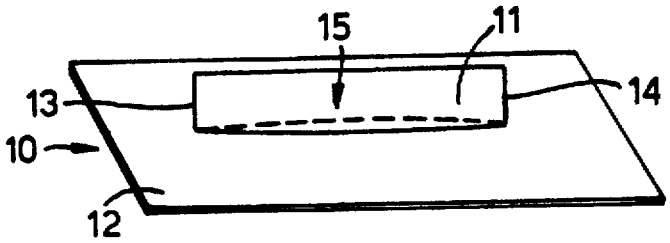
FIGS. 2A–2F disclose a first embodiment of the present invention.

For the purposes of example only, a non-limiting embodiment is shown in FIG. 2A, which is in the form of three-dimensional knitted component 10 comprising a steep ended, essentially rectangular pouch 11 horizontally orientated on a substantially flat panel 12. By horizontally orientated is meant orientated in a substantially course-wise direction. The pouch 11 has substantially flat sides 15 with steep ends 13 and 14. The ends 13, 14 of the pouch are closed in the continuous knitting process. The panel 12 may be part of a larger structure such as a seat cover similar to that described with reference to FIG. 1.

In order to continuously knit the component 10, it is necessary to develop a knitting pattern which will allow for the formation of a three-dimensional object from an essentially two-dimensional blank merely by joining together the edges of a flat area during the knitting process.

Figure 2B:
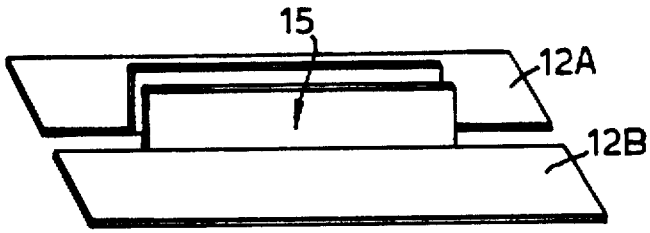
Figure 2C:
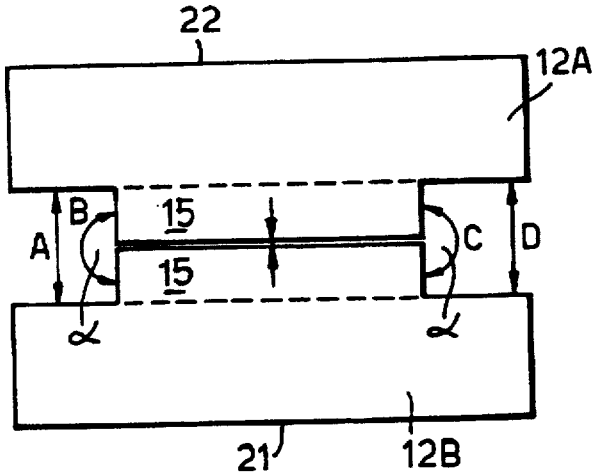
Figure 2D:
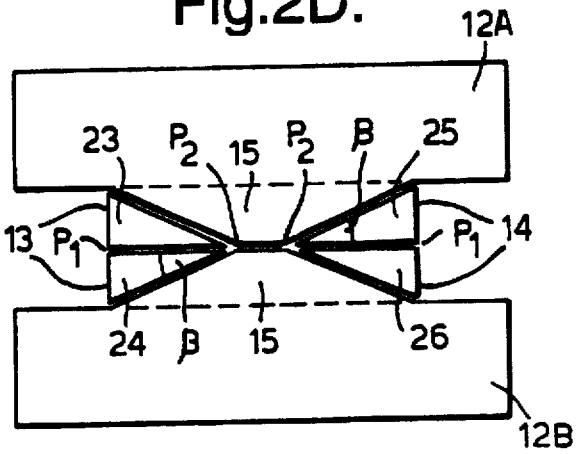
Figure 2E:
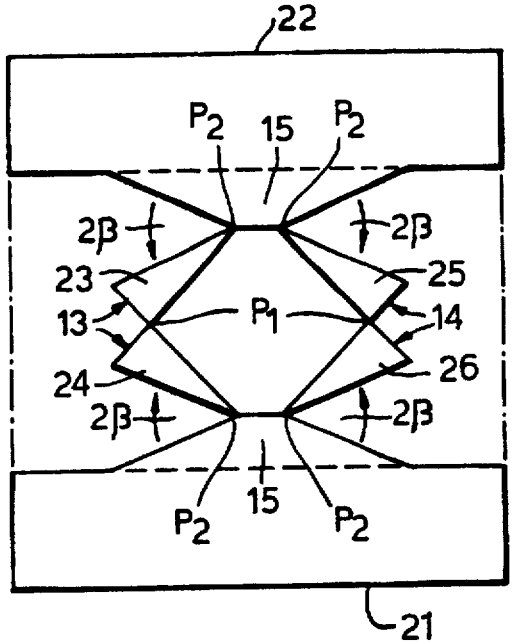

The knitting pattern, FIG. 2E, is developed by a series of steps, having determined the wale-wise direction for knitting the component:

(i) The component 10 is split horizontally, that is transversely to the wale-wise direction (FIG. 2B).

(ii) The two flat panel areas **12*a* and 12*b* are moved apart, allowing the sides 15 of the pouch to relocate into the general plane of the panel as shown in FIG. 2C, which is a two-dimensional development of the component 10**.

In order to continuously knit the three-dimensional component 10, it is necessary to trait from the lower edge 21 through to the upper edge 22 in a similar manner to that discussed with reference to FIG. 1. This can be achieved by joining together the edges connected by arrows A, B, C and D. Since the edges linked by arrow A and D lie on the same vertical (needle) lines, these can be quite easily joined as previously discussed. However, since the two pairs of edges which form the ends 13 and 14 and which are linked by the arrows B and C each lie on a single vertical line with a subtended angle $\alpha$ of 180° therebetween, it is not possible to join these edges together as part of the continuous knitting process.

The solution according to the present invention is to perform a geometric rearrangement on the two-dimensional development.

The side portions 15 of the blank are split so that the two pairs of edges 13 and 14 form in this case the bases of four congruent right angle triangular portions 23–26 each having an apex angle $\beta$ so that preferably $\beta=\alpha/8$ as shown in FIG. 2D. The sides of the triangles 23–26 extending away from the ends of the bases intersect at the point $P_2$ at their apices.

The two flat panel areas **12*a* and 12*b* are now moved further apart so that the triangular portions 23–26 pivot about their respective apex point $P_2$ with adjacent corners of adjacent triangular portions 23,24 and 25,26 remaining pivotally connected through the point $P_1$ as can be seen in FIG. 2E. The triangular portions 23–26 are pivoted away from the respective side 15** by an angle of $2\beta$.

The sides 13, 14, which formerly had a large angle (180°) subtended therebetween, now form the bases of the triangular portions 23–24 and the angles between the sides 13, 14 are reduced to an acceptable angle. If $\beta=\alpha/8$, no angle between edges-to-be-joined will exceed $\alpha/2$.

The final knitting pattern shown in FIG. 2E allows continuous knitting from the bottom edge 21 to the top edge 22. The edges-to-be-joined (shown by double-headed arrows) are arranged so that any non-horizontal edges to be joined have the same length and are biased at equal angles to the horizontal (course-wise) direction but on opposite bias angles. The smaller angles between the actual edges to be satisfactorily joined are preferably reduced to less than 90° to allow them to be joined by normal knitting.

Figure 2F:
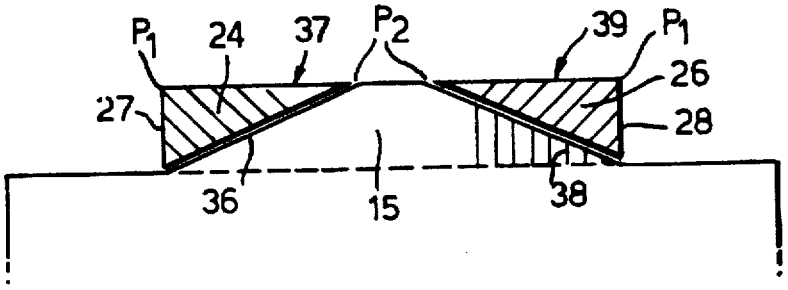

FIG. 2F shows the three-dimensional object, preferably a cover, after the continuous knitting process. The closed ends 13 and 14 are formed from the knitted together bases of the triangles 23,24 and 25,26, respectively, to form first sutures 27 and 28 and other suture lines (only some of which are shown) 36,37, 38,39 will extend from each end of the respective first sutures 27,28 towards a point of intersection $P_2$. These suture lines 36,37,38,39 correspond to the sides of the respective triangular areas 24 and 26, the upper suture lines 37 and 39 being common to the two pairs of triangular areas 23,24 and 25,26 respectively. As can be seen represented by lines, the wale-wise direction of the knitting pattern **2*e* gives rise to a knitted object in which the wale-wise direction of the knitting changes at the suture lines 36,37, 38,39**.

The pairs of edges 13 and 14, while illustrated as straight edges, could be curved edges or built up of a number of facets, where the maximum angle between any two facets on the two edges and any two tangents on the two curved edges does not exceed 270°. This technique is suitable for large angles α of between 90° and 270°, although it is most likely used for angles of between 90° and 180°.

Referring to FIGS. 3A–3F, FIG. 3A shows a second component 50 with a substantially horizontally orientated triangular pouch 51 protruding from a flat panel 52. The pouch 51 has substantially flat sides 55 and inclined ends 53,54 which meet at the apex of the pouch.

As before, in order to determine the shape of a knitting pattern for continuously knitting the component 50, it is necessary to make a two-dimensional development of the component. The component 50 is split horizontally so that two halves of the flat panel 52 are moved apart and each triangular side 55 of the pouch is made to lie in the general plane of the panel 52 (see FIG. 3B). The inclined ends 53,54 of the pouch 51 are formed from two pairs of edges 61,62 respectively linked by the double-headed arrows F and G. The angle between the edges 62 is greater than x°, where x° is the maximum knittable angle between the edges depending upon the application, and the angle δ between the edges 61 should not exceed 2x-γ. For some applications, x may be as large as 120° but will generally not exceed 90°.

Figure 3A:
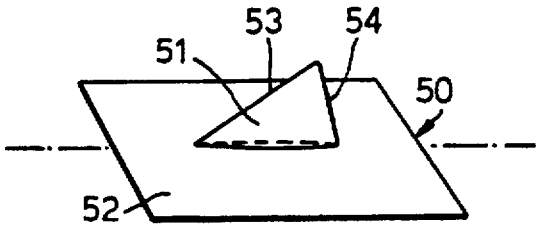
FIGS. 3A–3F disclose a second embodiment of the present invention.
Figure 3B:
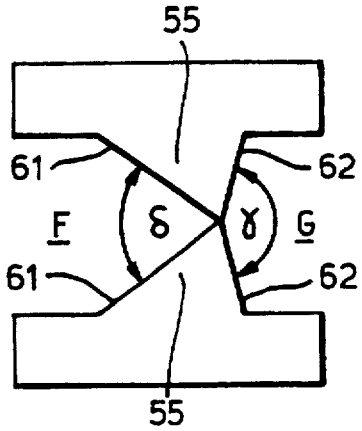
Figure 3C:
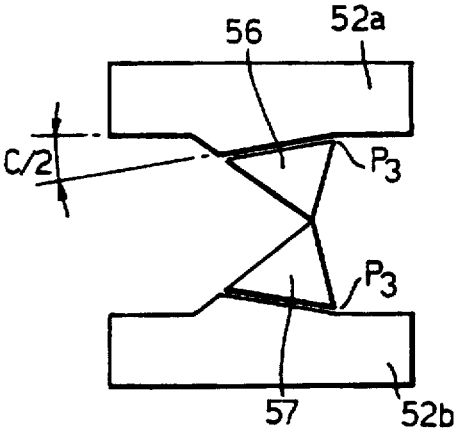
Figure 3D:
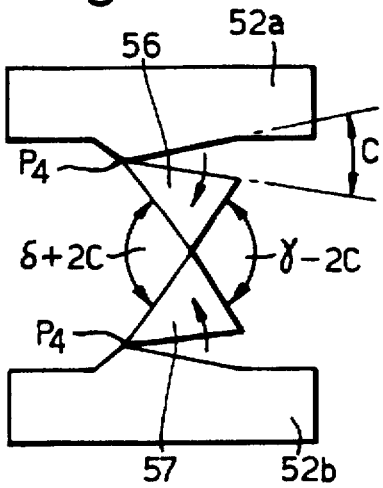

If the panel 52 is part of a larger structure, it is not practical to relatively rearrange the two halves of the development shown in FIG. 3B. In this case, during the geometric rearrangement, triangular portions 56, 57 of the triangular sides 55 are split off at angle C/2 formed by lines passing through the points $P_3$ where the respective larger angle edges G intersect the horizontal edge in the split panel portion 52, as shown in FIG. 3C. The two triangular portions 56 and 57 are then pivoted about their apices $P_4$ adjacent the small angle edges F by moving the two halves 52*a*, 52*b* of the flat panel apart. The two triangular portions 56, 57 swing through an angle of C where preferably $$C=\frac{(\gamma-\delta)}{4}$$

to make γ–2C=δ+2C, as shown in FIG. 3D.

The two triangular portions 56, 57 are congruent triangles having edges 61,62 which when knitted together form the inclined ends 53 and 54 of the pouch. The edges 61,62 intersect at a second point $P_5$ where the two triangular portions are pivotally connected. The other two sides of the triangle intersect at the apex at $P_4$. In this arrangement, the edges-to-be-joined are arranged so that any non-horizontal edges-to-be-joined to each other have the same length and equal bias angles to the horizontal and the angles between the edges-to-be-joined do not exceed x°.

Figure 3E:
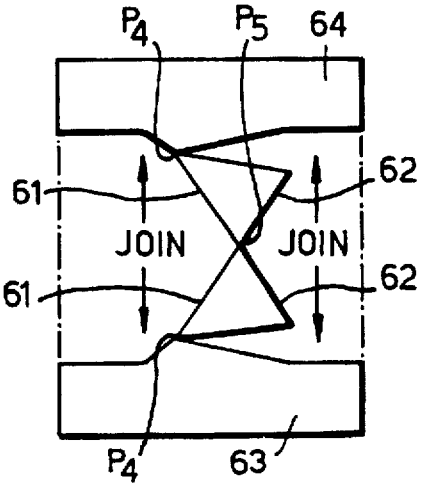

The final knitting pattern shown in FIG. 3E can then be continuously knitted from bottom edge 63 to top edge 64 to form the three-dimensional component. The above examples are illustrative only.

Figure 3F:
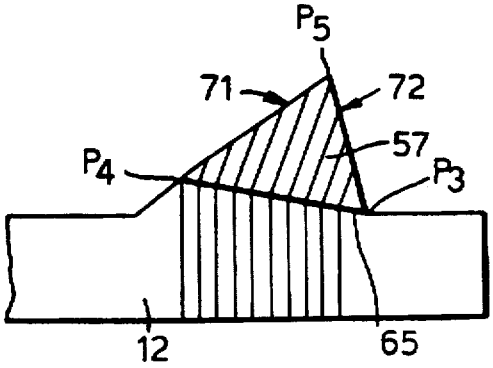

The knitted three-dimensional object is shown in FIG. 3F which will have suture lines 71,72 at the knitted together edges 61,62 and along the line 65 which represents one side of the triangular areas 56 and 57. The change in the wale-wise direction of the knitted object at the suture lines is represented by straight lines.

By using the technique of movement of triangular portions of the development of the component, it is possible to transform a large angle, which depending upon circumstances and application may not be satisfactorily knittable, to a preferred knittable condition comprising a plurality of smaller angles between a plurality of pairs of edges-to-be-joined.

While the technique has been demonstrated by simple geometric shaped pouches on a flat panel, it will be obvious that the teaching can be applied to edges on developments or blanks for other pouch shapes, or on developments or blanks for more complicated forms of three-dimensional knitting, for example, covers for upholstery in automobile especially for seat cushions and back rests.

What is claimed is:

1. A continuously weft knitted cover for a three-dimensional object comprising two adjoining triangular portions having two common knitted sutured edges with the third edge of each of said triangular portions being sutured to adjacent remainder portions of said cover such that a first suture line, formed from knitting one of said common sutured edges, has a second suture line, formed from the other of said common knitted sutured edges, extending from one of the ends of said first suture line, and third and fourth suture lines extending from the other end of said first suture line, said third and fourth suture lines each having a point of intersection with said second suture line in said other common edge.

2. A knitted cover as recited in claim 1 in which points of intersection of said third and fourth suture lines are substantially coincidental.

3. A method as recited in claim 1 in which the said triangular portions form at least a part of a pouch knitted into said cover.

4. A knitted cover as recited in claim 1 in which said triangles are substantially congruent.

* * * * *